US008047216B2

(12) United States Patent
Parry

(10) Patent No.: US 8,047,216 B2
(45) Date of Patent: Nov. 1, 2011

(54) STANDING AID

(75) Inventor: Ilsa Parry, Liverpool (GB)

(73) Assignee: Liverpool John Moores University, Liverpool (GB)

( * ) Notice: Subject to any disclaimer, the term of this patent is extended or adjusted under 35 U.S.C. 154(b) by 0 days.

(21) Appl. No.: 12/559,026

(22) Filed: Sep. 14, 2009

(65) Prior Publication Data

US 2011/0061695 A1 Mar. 17, 2011

(51) Int. Cl.
*A61H 3/02* (2006.01)

(52) U.S. Cl. ..... 135/65; 135/66; 135/72; 135/77; 5/81.1 R

(58) Field of Classification Search ..... 135/65–66, 135/71–72; D3/5–17; 482/75–76, 79; 5/81.1 R, 5/662; 623/38, 47, 53; 280/304.1
See application file for complete search history.

(56) References Cited

U.S. PATENT DOCUMENTS

| | | | | | |
|---|---|---|---|---|---|
| 3,174,494 | A | * | 3/1965 | Maguire, Jr. | 135/68 |
| 3,967,329 | A | | 7/1976 | Whitton, Jr. et al. | |
| 4,790,339 | A | * | 12/1988 | Bennett | 135/65 |
| 4,948,156 | A | * | 8/1990 | Fortner | 280/304.1 |
| 5,941,913 | A | * | 8/1999 | Woolnough et al. | 623/47 |
| 6,044,507 | A | * | 4/2000 | Smith | 5/662 |
| 6,158,804 | A | | 12/2000 | Luvisch | |
| 6,276,007 | B1 | * | 8/2001 | Brown | 5/81.1 R |
| D485,675 | S | * | 1/2004 | Selvig | D3/8 |
| D530,077 | S | * | 10/2006 | Smyth et al. | D3/7 |
| 2005/0178416 | A1 | * | 8/2005 | Owens | 135/69 |

FOREIGN PATENT DOCUMENTS

| | | | | |
|---|---|---|---|---|
| JP | 2001238711 | A | * | 9/2001 |
| WO | WO 9406393 | A2 | * | 3/1994 |
| WO | 0234196 | A3 | | 5/2002 |

OTHER PUBLICATIONS

Roe, Intellectual Property Office, Search Report for application No. GB1015292.4 dated Jan. 12, 2011, 3 pages.

* cited by examiner

*Primary Examiner* — Winnie Yip
(74) *Attorney, Agent, or Firm* — Hoffman Warnick LLC

(57) ABSTRACT

There is provided a standing aid comprising a leg engaging means and a handle and wherein the standing aid is adapted such that, in use, a user can brace the leg engaging means against a leg and pull on the handle so that the user is aided to move from a seated position to a standing position. Also provided is a method of using the aid.

19 Claims, 4 Drawing Sheets

STANDING AID

FIELD OF INVENTION

The present invention relates to standing aids, particularly but not exclusively, to standing aids for use by the elderly, injured and/or infirm.

BACKGROUND TO INVENTION

There are a number of known devices to assist the elderly and/or infirm to walk and stand. However, transitioning from a seated to a standing position can present a particular problem for many elderly, injured and/or infirm persons who may not have the muscle strength to stand simply by straightening their legs. Known walking aids such as walking frames and walking sticks are intended to support a person in a standing position and offer limited assistance to a person trying to get up from a seated position.

Accordingly, the present invention aims to address at least one disadvantage associated with the prior art whether discussed herein or otherwise.

SUMMARY OF INVENTION

According to a first aspect of the present invention there is provided a standing aid comprising a leg engaging means and a handle and wherein the standing aid is adapted such that, in use, a user can brace the leg engaging means against a leg and pull on the handle so that the user is aided to move from a seated position to a standing position.

Suitably, there is provided a standing aid comprising a leg engaging means and a handle and wherein the standing aid is adapted such that, in use, a user can brace the leg engaging means against and around a leg and pull on the handle so that the user is aided to move from a seated position to a standing position in one swift movement.

Suitably, the leg engaging means comprises a leg engaging section. Suitably, the standing aid comprises a leg engaging section and a handle and the standing aid is adapted such that, in use, a user can brace the leg engaging section against a leg and pull on the handle so that the user is aided to move from a seated position to a standing position.

Suitably, the standing aid comprises a ground contacting part adapted to contact the ground in use. Suitably, the standing aid comprises a ground contacting part adapted to contact the ground when the leg engaging section is braced against a user's leg. Alternatively, the standing aid may be adapted such that it does not touch the ground when used by a user to aid them to move from a seated to a standing position. The standing aid may thus be adapted to act only as a transfer aid and not as a walking aid.

Suitably, the leg engaging means comprises a leg engaging section. Suitably, the standing aid comprises a leg engaging section, a ground contacting part and a handle and the standing aid is adapted such that, in use, a user can brace the leg engaging section against and around a leg and pull on the handle so that the user is aided to move from a seated position to a standing position in one swift movement.

Suitably, the ground contacting part is adapted to brace against the ground when the leg engaging section is braced against a user's leg in use. Suitably, in use, the ground contacting part is adapted such that at least part of the force exerted on the standing aid by a user pulling on the handle is directed into the ground rather than into a user's leg.

Suitably, the leg engaging section comprises a ground contacting part adapted to contact the ground in use. Suitably, the leg engaging section comprises a ground contacting part adapted to contact the ground when the leg engaging section is braced against a user's leg.

Suitably, the standing aid is adapted such that it can be used as a walking aid. Suitably, the standing aid can be used as a walking stick. Suitably, the standing aid can be held by the handle and used as a walking stick for support.

Suitably, the standing aid is adapted such that, in use, it has a contact area of at least 2 $cm^2$ with the ground. Suitably, the standing aid is adapted such that, in use, it has a contact area of at least 4 $cm^2$ with the ground. Suitably, the standing aid is adapted such that, in use, it has a contact area of at least 5 $cm^2$ with the ground, for example a contact area of at least 6 $cm^2$; 7 $cm^2$; 8 $cm^2$; 9 $cm^2$; or 10 $cm^2$. Suitably, the standing aid is adapted such that it has a contact area of between 4 $cm^2$ and 10 $cm^2$ with the ground.

Suitably, the standing aid comprises a ground contacting part having a surface area of at least 2 $cm^2$. Suitably, the standing aid comprises a ground contacting part having a surface area of at least 4 $cm^2$. Suitably, the standing aid comprises a ground contacting part having a surface area of at least 5 $cm^2$, for example a surface area of at least 6 $cm^2$; 7 $cm^2$; 8 $cm^2$; 9 $cm^2$; or 10 $cm^2$.

Suitably, the standing aid comprises a ground contacting part adapted, in use, to extend for at least 2 cm in a front to back direction. Suitably, the ground contacting part extends for at least 3 cm in the front to back direction, for example for at least 4 cm; 5 cm; or 6 cm.

Suitably, the standing aid comprises a ground contacting part adapted, in use, to extend for at least 2 cm in the heel to toe direction. Suitably, the ground contacting part extends for at least 3 cm in the heel to toe direction, for example for at least 4 cm; 5 cm; or 6 cm.

Suitably, the standing aid comprises a ground contacting part having an area which contacts the ground in use which lies at least 2 cm forward of another area which contacts the ground in use. Suitably, the area between said areas also contacts the ground.

Suitably, the standing aid comprises a ground contacting part having an area which contacts the ground in use which lies at least 2 cm further from the heel and closer to the toes than another area which contacts the ground in use. Suitably, the area between said areas also contacts the ground.

Suitably, the ground contacting part has a free end which is the forward most part of the ground contacting part in use.

Suitably, the standing aid comprises a ground contacting part adapted, in use, to lie to one side of a user's foot when the leg engaging means engages the user's leg. The standing aid may comprise a ground contacting part or parts adapted to lie to both sides of a user's foot. The second leg engaging part may go around both sides of the heel and so may have two prongs which may each contact the ground in use. Suitably, the standing aid comprises a ground contacting part adapted to lie only to one side of a user's foot. The ground contacting part may also lie to the rear of a user's foot in use.

The standing aid may comprise a ground contacting part adapted to extend under part of a user's foot in use, suitably under part of a user's heel. The standing aid may comprise a ground contacting part adapted, in use, to contact the ground below a part of a user's foot, suitably below a part of a user's heel.

Suitably, the standing aid is adapted such that, in use, it only contacts the ground on one side of a user's foot and not on both. This may minimise the risk of the standing aid becoming caught around a user's foot once they are stood up and so may minimise the risk of the standing aid causing a user to trip once they begin to walk.

Suitably, the standing aid is adapted such that, in use, the ground contacting part only contacts the ground on one side, and optionally behind, a user's foot and the side of the foot on which it contact the ground is the opposite to the side of the leg which the standing aid passes on between the first and second leg engaging parts. The standing aid may thus be adapted to spiral around a user's leg in use. Suitably, the standing aid is adapted to spiral around a user's leg in use such that it can be used on either leg.

Suitably, the ground contacting part has a length of at least 2 cm. Suitably, the ground contacting part has a length of at least 3 cm, for example at least 4 cm; 5 cm; or 6 cm. Suitably, the ground contacting part has a width of at least 0.5 cm. Suitably, the ground contacting part has a width of at least 1 cm, for example at least 1.5 cm; 2 cm or 2.5 cm.

Suitably, the leg engaging means, suitably the leg engaging section, comprises parts adapted to engage opposed sides of a user's leg in use.

Suitably, the leg engaging means comprises a first part for engaging the front of a user's leg. Suitably, said first part is adapted to brace against the front of a user's leg. Suitably, the leg engaging means comprises a second part for engaging the back of a user's leg and/or the back of a user's foot. Suitably, said second part is adapted to brace against the back of a user's leg and/or the back of a user's foot. Suitably said second part has a ground contacting part formed at the base thereof.

Suitably, the leg engaging means comprises parts adapted to engage the front and back of a leg. Suitably, the leg engaging means comprises a part adapted to engage the front of a leg and a part arranged to engage the back of said leg and/or the back of a foot.

Suitably, the leg engaging means comprises a part adapted to engage the front of a leg at the knee and/or between the knee and the foot. Suitably, the leg engaging means comprises a part adapted to engage the front of a leg at or just below the knee.

Suitably, the leg engaging means comprises a part adapted to engage the back of a leg at the heel and/or between the heel and the knee. Suitably, the leg engaging means comprises a part adapted to engage the back of a leg at or near the ankle.

Suitably, the leg engaging means comprises a first part adapted to engage the front of a leg and a second part adapted to engage the back of a leg and wherein, in use, at least a portion of said first part engages the leg at a point higher than does at least a portion of said second part. Suitably, in use, all of said first part engages a leg at a higher point than does any of said second part.

Suitably, the leg engaging means comprises a first part adapted to conform to the front of a leg. Suitably, the leg engaging means comprises a first part adapted to conform to the knee area of a leg. Suitably, the leg engaging section comprises a first part adapted to cup the knee.

Suitably, the first leg engaging part is adapted to contact a user's leg, suitably the user's knee, over a surface area of at least 10 $cm^2$. Suitably, the first leg engaging part is adapted to contact a user's leg over a surface area of at least 20 $cm^2$. Suitably, the first leg engaging part is adapted to contact a user's leg over a surface area of at least 50 $cm^2$. Suitably, the first leg engaging part is adapted to contact a user's leg over a surface area of at least 80 $cm^2$; for example at least: 90 $cm^2$; 100 $cm^2$; 110 $cm^2$; 120 $cm^2$; 130 $cm^2$; 140 $cm^2$; 150 $cm^2$; 160 $cm^2$; 170 $cm^2$; 180 $cm^2$; 190 $cm^2$; 200 $cm^2$; 210 $cm^2$; 220 $cm^2$; 230 $cm^2$; 240 $cm^2$; or 250 $cm^2$. Suitably, the first leg engaging part is adapted to contact a user's leg over a surface area of between 150 $cm^2$ and 250 $cm^2$; for example between 180 $cm^2$; and 220 $cm^2$; for example around 200 $cm^2$.

Suitably, the first leg engaging part has a concave face adapted, in use, to engage a user's leg, suitably a user's knee. Suitably, the first leg engaging part has a curved face adapted, in use, to engage a user's leg, suitably a user's knee. Suitably, the radius of the curved face of the first leg engaging part (measured in the horizontal, in use, plane) is between 2 cm and 12 cm. Suitably, the radius is between 5 cm and 9 cm, for example around 7 cm.

Suitably, the leg engaging means comprises a second part adapted to conform to the back of a leg. Suitably, the leg engaging means comprises a second part adapted to conform to the heel area of a leg. Suitably, the leg engaging means comprises a second part adapted to cup the heel.

Suitably, the second leg engaging part is adapted to contact a user's leg, suitably the user's heel, over a surface area of at least 2 $cm^2$. Suitably, the second leg engaging part is adapted to contact a user's leg over a surface area of at least 4 $cm^2$. Suitably, the second leg engaging part is adapted to contact a user's leg over a surface area of at least 5 $cm^2$. Suitably, the first leg engaging part is adapted to contact a user's leg over a surface area of at least 6 $cm^2$; for example at least: 7 $cm^2$; 8 $cm^2$; 9 $cm^2$; 10 $cm^2$; 11 $cm^2$; 12 $cm^2$; 13 $cm^2$; 14 $cm^2$; or 15 $cm^2$. Suitably, the second leg engaging part is adapted to contact a user's leg over a surface area of between 5 $m^2$ and 15 $cm^2$; for example between 8 $cm^2$; and 12 $cm^2$; for example around 10 $cm^2$.

Suitably, the second leg engaging part has a concave face adapted, in use, to engage a user's leg, suitably a user's heel. Suitably, the second leg engaging part has a curved face adapted, in use, to engage a user's leg, suitably a user's heel. Suitably, the radius of the curved face of the second leg engaging part (measured in the horizontal, in use, plane) is between 1 cm and 9 cm. Suitably, the radius is between 3 cm and 7 cm, for example around 5 cm.

Suitably, the second leg engaging part is adapted, in use, to engage a user's heel below the ankle joint. Suitably, the leg engaging means is adapted, in use, to lock the lower leg in place at the front of the knee and the back of the ankle and/or heel.

The standing aid may comprise a second leg engaging part adapted to engage part of the underside of a user's foot in use, suitably the underside of a user's heel. Suitably, the second leg engaging part comprises a lip adapted to locate under a user's heel in use. Suitably, the standing aid is adapted such that, in use, no part of it contacts the ground under a user's foot.

Suitably, the leg engaging section comprises a first part adapted to engage the front of a leg and a part of a side of a leg. Suitably, the leg engaging section comprises a second part adapted to engage the back of a leg and a part of a side of a leg.

Suitably, the leg engaging section is adapted to curve around a leg. Suitably, the leg engaging section is adapted, in use, to curve around a leg from the front to the back.

Suitably, the leg engaging section is adapted to engage a side of a leg. Suitably, the leg engaging section is adapted to curve around a leg to engage the front, a side and the bottom of a leg. Suitably, the leg engaging section is adapted to curve around a leg in use such that, moving towards the ground, it engages the front and then a side and then the back of a leg.

Suitably, the leg engaging section is adapted to pass around a side of a leg from the front to the back of a leg. Suitably, the leg engaging section is adapted to be able to pass around the outside of a leg from the front to the back of a leg. Suitably, the leg engaging section is adapted to be able to pass around the inside of a leg from the front to the back of a leg. Suitably, in use, the leg engaging section is positioned to pass around the outside of a leg. Suitably though it may alternatively be positioned to pass around the inside of a leg and it may therefore be used on either the left or right leg.

Suitably, the leg engaging section is adapted to engage either side of a leg. Suitably, the leg engaging section is adapted to engage the outside of a leg.

Suitably, the leg engaging section comprises a first part adapted to engage the front of a leg and to extend around a part of a first side of a leg towards a second part. Suitably, the leg engaging section comprises a second part adapted to engage the back of a leg and to extend around a part of a first side of a leg towards a first part.

The leg engaging section may comprise first and second parts which are directly connected to one another. Alternatively, the leg engaging section may comprise a connecting part connecting the first and second parts to one another. Suitably, the connecting section is adapted to extend around a side of a leg. Suitably, the connecting section is adapted to engage the side of a leg.

Suitably, in use, the handle is located forward of the leg engaging section. Suitably, in use the handle is located forward of the first leg engaging part. Suitably, in use the handle is located above the leg engaging section. Suitably, in use the handle is located above the first leg engaging part.

Suitably, the standing aid is adapted such that a handle end lies at least 10 cm from the leg engaging section. Suitably, the handle end lies at least 20 cm from the leg engaging section, for example at least 40 cm from the leg engaging section. Suitably, the standing aid is adapted such that a handle end lies at least 10 cm from the first leg engaging part. Suitably, the handle end lies at least 20 cm from the first leg engaging part, for example at least 40 cm from the first leg engaging part.

Suitably, in use, a handle end of the standing aid lies at least 10 cm from a user's knee cap when the leg engaging section engages the user's leg. Suitably, the handle end lies at least 20 cm, for example at least 40 cm, from a user's knee cap in use when the leg engaging section engages the user's leg. Suitably, in use a handle end of the standing aid is located above a user's knee cap when the leg engaging section engages the user's leg. Suitably, in use a handle end of the standing aid is located forward of a user's knee cap when the leg engaging section engages the users leg.

Suitably, the standing aid comprises hanging means by which it can be hung up. Suitably, the standing aid comprises a hollow or aperture by which it can be hung up. Suitably, the standing aid comprises a recess located near to where the first leg engaging part meets the handle. Alternatively, or in addition, the standing aid may comprise a hook.

Suitably the hanging means is adapted to allow the standing aid to be hooked onto an article of furniture, for example hooked onto the back of a chair or the corner of a table. A user may thus be able to hang the standing aid in a readily accessible position.

Suitably, the standing aid is adapted to be freestanding. Suitably, the ground contacting part comprises a foot on which the standing aid can be stood.

Suitably, the standing aid is adapted to be an appropriate size for a user. The standing aid may be provided in a range of sizes, for example three sizes, to suit different sized users.

Suitably, the standing aid is adapted such that, in use, the vertical distance from the ground contacting part to the handle end is between 90 cm and 110 cm, for example around 100 cm.

Suitably, the standing aid is adapted such that, in use the horizontal distance from the forward most part of the ground contacting part to the handle end is between 5 cm and 25 cm, for example around 15 cm.

Suitably, the standing aid is adapted such that, in use, the vertical distance from the top of the second leg engaging part to the bottom of the first leg engaging part is between 20 cm and 70 cm, for example around 50 cm.

Suitably, the standing aid is adapted such that, in use, the horizontal distance from the top of the second leg engaging part to the bottom of the first leg engaging part is between 7 cm and 25 cm, for example around 12 cm.

Suitably, the standing aid is adapted such that, in use, the vertical distance from the top of the first leg engaging part to the handle end is between 20 cm and 70 cm, for example around 50 cm.

Suitably, the standing aid is adapted such that, in use, the horizontal distance from the top of the first leg engaging part to the handle end is between 5 cm and 25 cm, for example around 10 cm.

Suitably, the standing aid is a one piece construction. Alternatively, the standing aid may be dual shot injection moulded and may be gas injection moulded. Suitably, the standing aid comprises a plastics material. Alternatively the standing aid may comprise a metal. Suitably, the standing aid comprises a composite material, for example a carbon fibre/polypropylene based composite. The standing aid may comprise two materials and may have a different texture on a handle and/or ground contacting part which may provide better grip characteristics.

It will be understood that as used herein the terms "leg engaging", "against a leg" and "contact a leg" encompass both direct contact with a leg and indirect contact with a leg via clothing.

According to a second aspect of the present invention there is provided a method of moving from a seated position to a standing position wherein the method comprises a user locating a standing aid according to the first aspect such that the leg engaging means of said aid engages the user's leg and the user then pulling on the handle of the standing aid to aid them to stand.

Suitably, the method comprises locating the standing aid such that a part of the leg engaging section braces against the front of the user's leg. Suitably, the method comprises locating the standing aid such that a part of the leg engaging section braces against the back of the user's leg and/or the back of a user's foot. Suitably, the method comprises locating the standing aid such that a part of the standing aid braces against the ground. Suitably, the method comprises locating the standing aid such that the leg engaging section braces against the front of the user's leg and the back of the user's leg.

Suitably, the method comprises a user self levering themselves from a sitting to a standing position.

BRIEF DESCRIPTION OF DRAWINGS

The present invention will now be illustrated by way of example with reference to the accompanying drawings in which.

DETAILED DESCRIPTION OF PREFERRED EMBODIMENTS

FIGS. 1 to 8 illustrate four embodiments of a standing aid and the use thereof.

Figure 1:
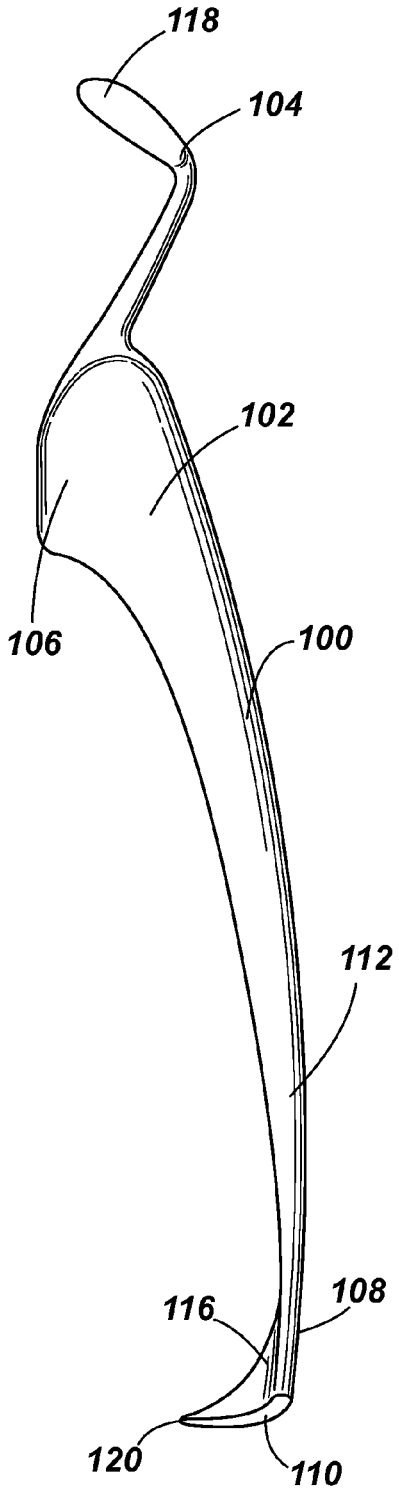
FIG. 1 is a perspective view of an embodiment of a standing aid.

In the embodiment of FIG. 1 the standing aid 100 comprises a leg engaging section 102 and a handle 104. The leg engaging section comprises a first leg engaging part 106 adapted to engage the front of a user's leg in use and a second leg engaging part 108 adapted to engage the back of a user's leg in use. The standing aid 102 further comprises a ground contacting part 110 adapted to contact the ground in use and which is provided at the base of the leg engaging section 102. In addition to the first and second leg engaging parts 106, 108, the leg engaging section comprises a connecting part 112 which connects said first and second leg engaging parts 106, 108 and is adapted, in use, to pass around a side of a user's leg.

The first leg engaging part 106 is adapted to engage the knee and has a curved face (not shown) which bears against the user's leg in use. The face has a radius of around 7 cm (measured in the horizontal plane) at the knee and is arranged to contact the leg over an area of around 200 $cm^2$.

The second leg engaging part 108 is adapted to engage the heel and has a curved face 116 which bears against the user's leg in use. The face 116 has a radius of around 5 cm (measured in the horizontal plane) at the heel and is arranged to contact the leg over an area of around 10 $cm^2$.

In use, the vertical distance from the ground contacting part 110 to the end 118 of the handle end is around 100 cm. In use, the horizontal distance from the forward most part 120 of the ground contacting part to the handle end 118 is around 15 cm.

In use, the vertical distance from a mid region of the second leg engaging part 108 to a mid region of the first leg engaging part 106 is around 50 cm. In use, the horizontal distance from a mid region of the second leg engaging 108 part to mid region of a first leg engaging part 106 is around 12 cm.

In use, the vertical distance from a mid region of the first leg engaging part 106 to the handle end 108 is around 50 cm. In use, the horizontal distance from a mid region of the first leg engaging part to the handle end is around 10 cm.

The ground contacting part 110 is adapted such that it only contacts the ground on one side of a user's foot in use and not on both. The ground contacting part also contacts the ground behind a user's foot when the standing aid engages said user's leg in use. In this embodiment the ground contacting part 110 has a contact area of around 8 $cm^2$. The standing aid can thus contact the ground over a sufficiently wide area that it can also function as a walking aid which a user can use in place of a conventional walking stick.

Figure 6:
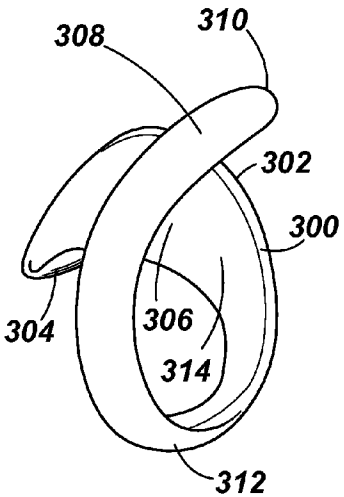
FIG. 6 is an underside perspective view of the standing aid of FIG. 3.

The operation of the standing aid 110 is shown schematically in FIG. 6. The same principle applies in relation to the alternative embodiments of the standing aid 200 and 300 which will be described hereafter.

Figure 7:
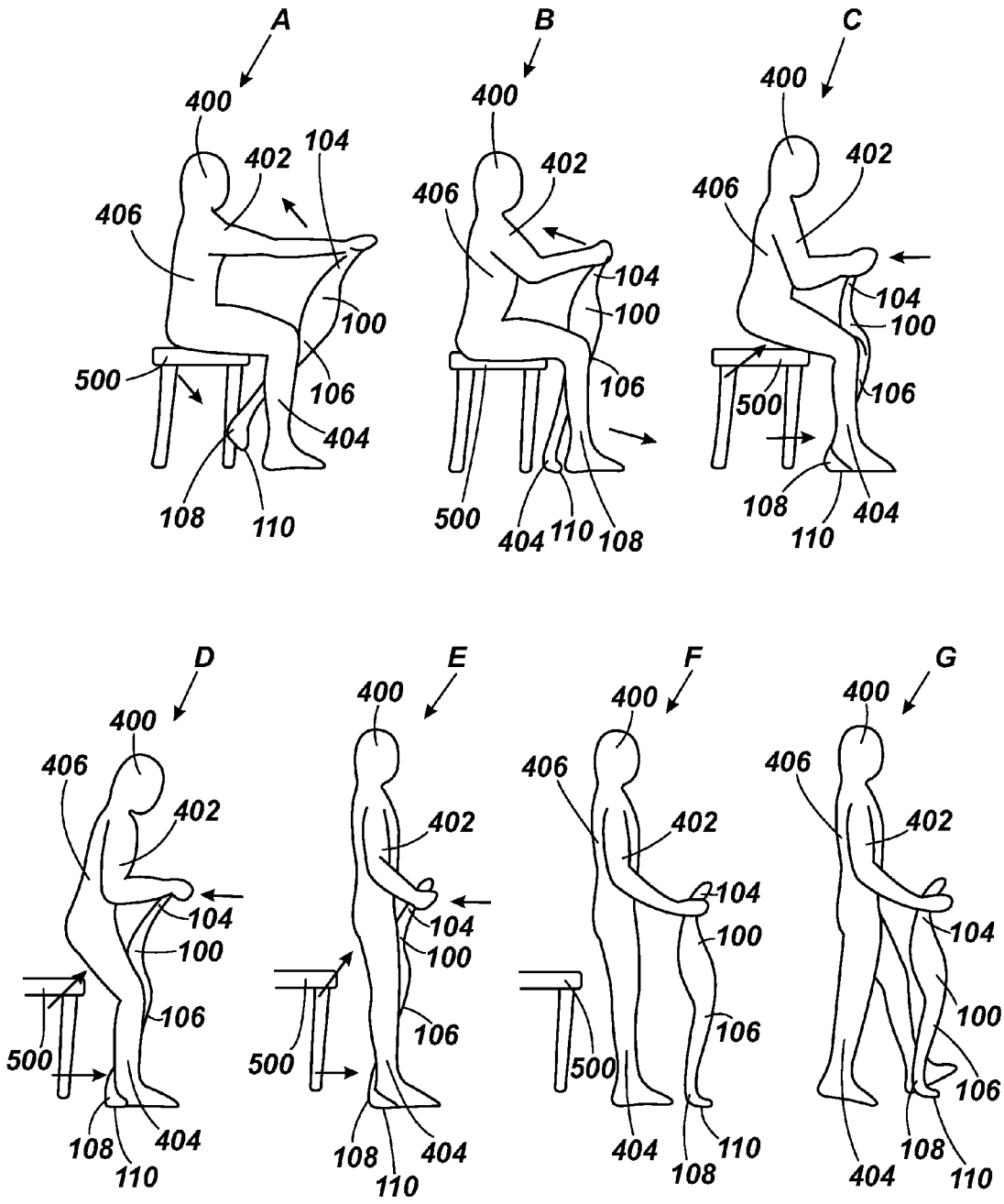
FIG. 7 is schematic showing the use of a standing aid.

As shown by FIG. 7 a user 400 begins from a seated position (position A) and holds the handle 104 of the standing aid 100 with an extended arm 402 and locates the first leg engaging part 106 in front of his/her leg 404 and the second leg engaging part 108 behind his/her leg 404.

FIG. 7 illustrates the use on a right leg but the standing aid can also be used on a left leg. For convenience the user is referred to as male hereafter but the standing aid can be used by males and females alike.

The user 400 then bends his arm 402 (position B) bringing the first leg engaging part 106 into contact with the front of his leg 404. Continuing this movement also brings the second leg engaging part 108 into contact with the back of his leg 404 and also brings the ground contacting part 110 into contact with the ground.

The user 400 then bends his arm 402 further (position C). This causes the leg engaging parts 104, 106 to brace against opposed sides of the user's leg 404 such that as he bends his arm 402 and pulls on the handle 104 his torso 406 is pulled forwards and his bottom begins to be lifted from the seat 500.

Further bending of the arm 402 (position D) allows the user 400 to self lever himself from the seat 500 bringing his torso 406 forwards towards the handle 104 and lifting his bottom from the seat. At the same time the user straightens his leg 404 which also helps to bring his torso 406 forward over his foot.

With the user's torso 406 now located more over his foot he is able to straighten his leg 404 and his arm 402 and stand upright (position E).

The user 400 can then extend his arm 402 and lift the standing aid 100 to position it in front of him and away from the leg such that the ground contacting part 110 engages the ground (position F).

The user can then step forwards towards the standing aid 100 using it as a walking aid. Steps E and F can be repeated and the standing aid used in place of a walking aid such as a walking stick.

Figure 2:
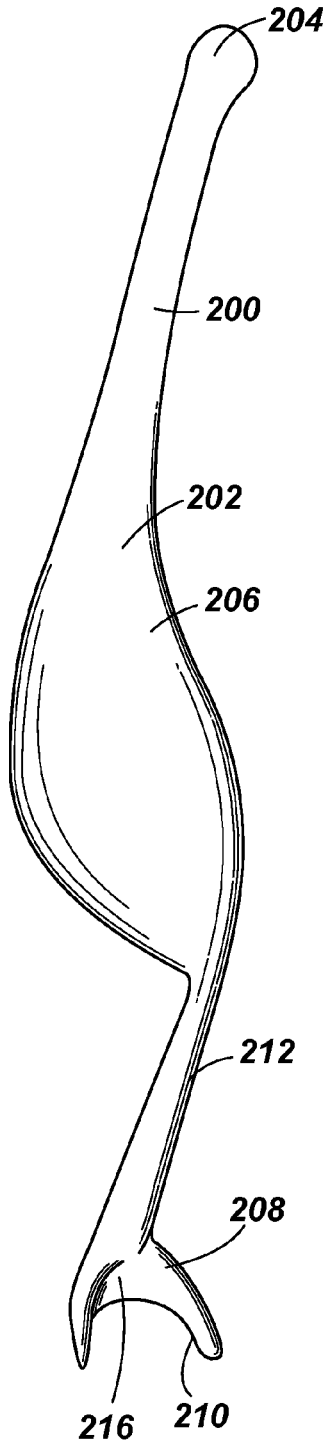
FIG. 2 is a perspective view of an alternative embodiment of a standing aid.
Figure 3:
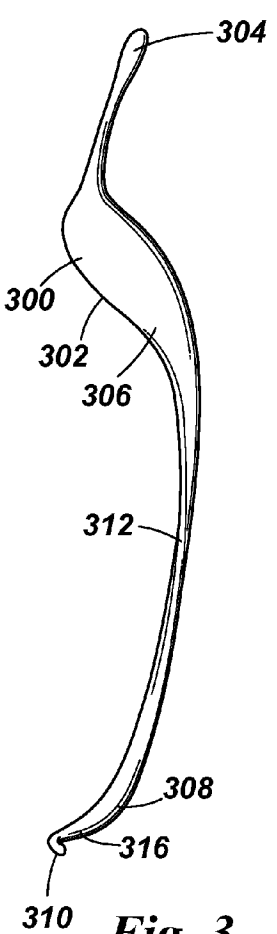
FIG. 3 is a front perspective view of an alternative embodiment of a standing aid.
Figure 4:
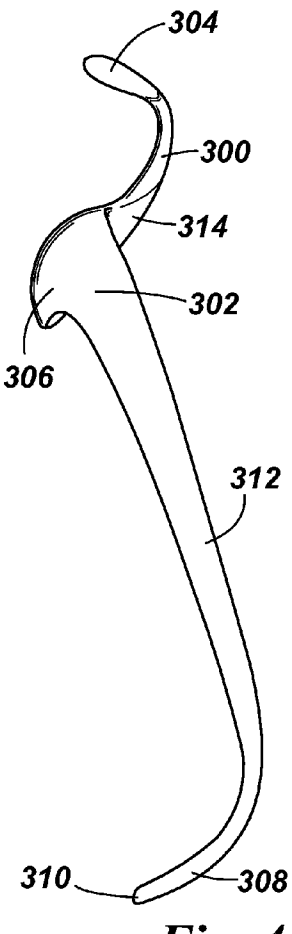
FIG. 4 is a left perspective view of the standing aid of FIG. 3.
Figure 5:
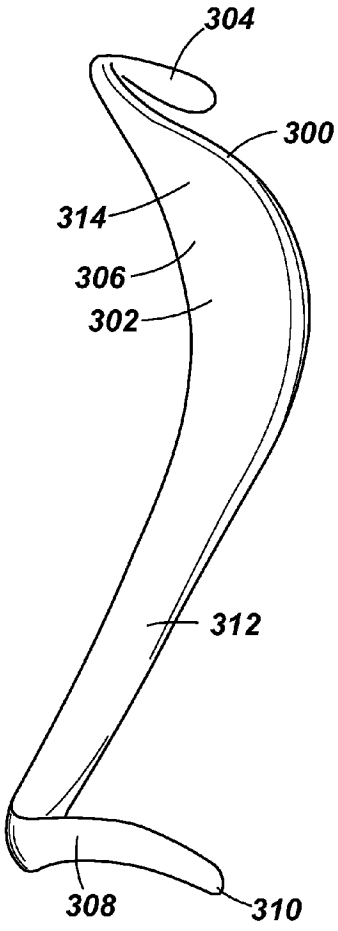
FIG. 5 is a right perspective view of the standing aid of FIG. 3.

FIG. 2 illustrates an alternative embodiment of a standing aid 200. This differs from the standing aid 100 of the first embodiment in that it has a second leg engaging part 208 which is adapted to engage the back and either side of a user's heel and which also has a ground contacting part 210 which is adapted to engage the ground on either side of a user's foot.

The standing aid 200 comprises a leg engaging section 202 and a handle 204. The leg engaging section comprises a first leg engaging part 206 adapted to engage the front of a user's leg in use and a second leg engaging part 208 adapted to engage the back of a user's leg in use. The standing aid 202 further comprises a ground contacting part 210 adapted to contact the ground in use and which is provided at the base of the leg engaging section 202. In addition to the first and second leg engaging parts 206, 208, the leg engaging section comprises a connecting part 212 which connects said first and second leg engaging parts 206, 208 and is adapted, in use, to pass around a side of a user's leg.

The first leg engaging part 206 is adapted to engage the knee and has a curved face (not shown) which bears against the user's leg in use. The second leg engaging part 208 is adapted to engage the heel and has a curved face 216 which bears against the user's leg in use.

Figure 8:
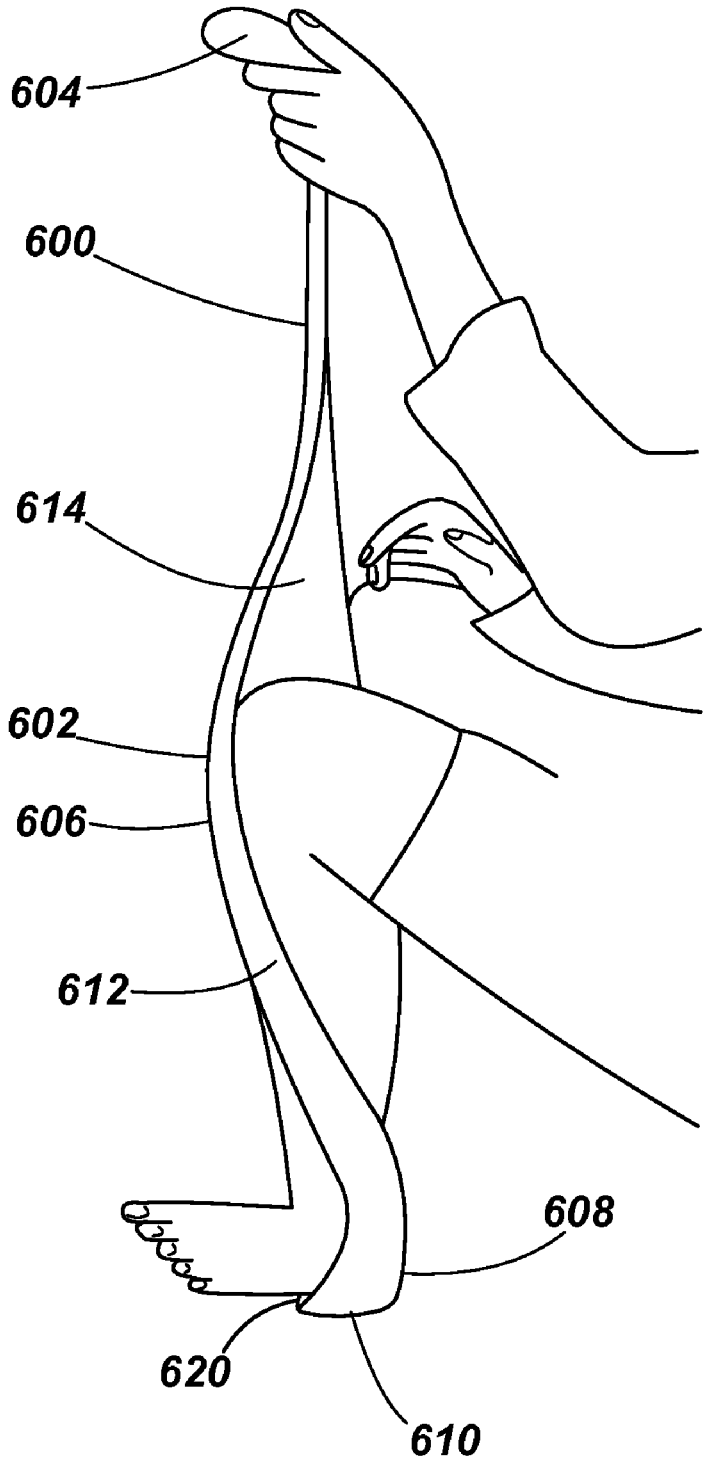
FIG. 8 shows an alternative embodiment of a standing aid located against a leg of a seated user.

FIG. 8 illustrates an alternative embodiment of a standing aid 600 positioned against a user's leg such that a user can brace the leg engaging section against his/her leg and pull on the handle to aid the user to move from a seated position to a standing position.

The standing aid 600 differs from that of the second embodiment in that the ground contacting part 610 is adapted to extend under part of a user's heel in use and the second leg engaging part 608 is adapted to engage the underside as well as the back and side's of a users heel in use.

The standing aid 600 comprises a leg engaging section 602 and a handle 604. The leg engaging section comprises a first leg engaging part 606 adapted to engage the front of a user's leg in use and a second leg engaging part 608 adapted to engage the back of a user's leg in use. The standing aid 602 further comprises a ground contacting part 610 adapted to contact the ground in use and which is provided at the base of the leg engaging section 602. In addition to the first and second leg engaging parts 606, 608, the leg engaging section comprises a connecting part 612 which connects said first and second leg engaging parts 606, 608 and is adapted, in use, to pass around a side of a user's leg.

The first leg engaging part 606 is adapted to engage the knee and has a curved face 614 which bears against the user's leg in use. The second leg engaging part 608 is adapted to engage the heel and has a curved face (not shown) which bears against the user's leg in use as well as a lip 620 adapted to locate under a user's heel in use.

The operation of the standing aid is substantially the same as that shown in FIG. 7 with the additional feature that a user must lift his or her heel slightly to allow the lip 620 to locate under it.

FIGS. 3 to 6 illustrate an alternative embodiment of a standing aid 300. This differs from the standing aid 100 of the first embodiment in that the ground contacting part 310 has a small contact area with the ground and the standing aid 300 may thus not be particularly suitable for use as a walking aid. The ground contacting part is adapted such that it only contacts the ground on one side of a user's foot in use and does not engage the ground behind the foot.

The standing aid 300 comprises a leg engaging section 302 and a handle 304. The leg engaging section comprises a first leg engaging part 306 adapted to engage the front of a user's leg in use and a second leg engaging part 308 adapted to engage the back of a user's leg in use. The standing aid 302 further comprises a ground contacting part 310 adapted to contact the ground in use and which is provided at the base of the leg engaging section 302. In addition to the first and second leg engaging parts 306, 308, the leg engaging section comprises a connecting part 312 which connects said first and second leg engaging parts 306, 308 and is adapted, in use, to pass around a side of a user's leg.

The first leg engaging part 306 is adapted to engage the knee and has a curved face 214 which bears against the user's leg in use. The second leg engaging part 308 is adapted to engage the heel and has a curved face 316 which bears against the user's leg in use.

The operation of the standing aid is substantially the same as that shown in FIG. 7.

The invention claimed is:

1. A standing aid comprising a leg engaging portion and a handle and wherein the standing aid is adapted such that, in use, a user can brace the leg engaging portion against a leg and pull on the handle so that the user is aided to move from a seated position to a standing position wherein the leg engaging portion comprises a first part for engaging a front of a user's leg and a second part for engaging a back of a user's leg and/or a back of a user's foot in use and wherein the first leg engaging part has a concave face adapted, in use, to engage a user's leg.

2. A standing aid according to claim 1, wherein the leg engaging portion comprises a leg engaging section.

3. A standing aid according to claim 1, wherein the standing aid comprises a ground contacting part adapted to contact the ground in use.

4. A standing aid according to claim 1, wherein the standing aid can be used as a walking aid.

5. A standing aid according to claim 1, wherein the standing aid has a contact area of between about 4 $cm^2$ and about 10 $cm^2$ with the ground.

6. A standing aid according to claim 1, wherein the standing aid comprises a ground contacting part which, in use, lies to one side of a user's foot when the leg engaging portion engages the user's leg.

7. A standing aid according to claim 1, wherein the standing aid comprises a ground contacting part or parts which lie to both sides of a user's foot.

8. A standing aid according to claim 1, wherein the standing aid comprises a ground contacting part which lies only to one side of a user's foot.

9. A standing aid according to claim 1, wherein the standing aid comprises a ground contacting part which extends under part of a user's foot in use.

10. A standing aid according to claim 1, wherein the leg engaging portion comprises parts which engage opposed sides of a user's leg in use.

11. A standing aid according to claim 1, wherein the leg engaging portion comprises a part for engaging a front of a leg at the knee and/or between the knee and a foot.

12. A standing aid according to claim 1, wherein the leg engaging portion comprises a part for engaging a back of a leg at the heel and/or between the heel and a knee.

13. A standing aid according to claim 1, wherein the leg engaging portion comprises a first part which conforms to a front of a leg.

14. A standing aid according to claim 13, wherein the first part is adapted to contact a user's leg over a surface area of at least about 10 $cm^2$.

15. A standing aid according to claim 13, wherein the leg engaging portion comprises a second part which conforms to the back of a leg.

16. A standing aid according to claim 15, wherein the second part is adapted to contact a user's leg, over a surface area of at least about 2 $cm^2$.

17. A standing aid according to claim 1, wherein the standing aid comprises hanging portion by which it can be hung up.

18. A standing aid according to claim 1, wherein the standing aid is freestanding.

19. A method of moving from a seated position to a standing position wherein the method comprises a user locating a standing aid according to claim 1 such that the leg engaging portion of said aid engages the user's leg and the user then pulling on the handle of the standing aid to aid them to stand.

* * * * *